US007432662B2

(12) United States Patent
Busse

(10) Patent No.: US 7,432,662 B2
(45) Date of Patent: Oct. 7, 2008

(54) CIRCUIT ARRANGEMENT AND METHOD FOR OPERATING AT LEAST ONE LAMP

(75) Inventor: Olaf Busse, München (DE)

(73) Assignee: Patent -Treuhand-Gesellschaft fur Elektrisch Gluhlampen mbH, Munich (DE)

( * ) Notice: Subject to any disclaimer, the term of this patent is extended or adjusted under 35 U.S.C. 154(b) by 63 days.

(21) Appl. No.: 11/375,064

(22) Filed: Mar. 15, 2006

(65) Prior Publication Data

US 2006/0214594 A1 Sep. 28, 2006

(30) Foreign Application Priority Data

Mar. 23, 2005 (DE) ..... 10 2005 013 564

(51) Int. Cl.
*H05B 37/02* (2006.01)

(52) U.S. Cl. ..... 315/209 T; 315/309; 315/360

(58) Field of Classification Search ..... 315/209 R, 315/219, 224, 225, 226, 209 T, 291, 299, 315/308, 309, 360, DIG. 5, DIG. 7
See application file for complete search history.

(56) References Cited

U.S. PATENT DOCUMENTS

| | | | | |
|---|---|---|---|---|
| 3,597,652 | A * | 8/1971 | Gates, Jr. | 315/205 |
| 5,854,538 | A * | 12/1998 | Krummel | 315/105 |
| 6,140,771 | A * | 10/2000 | Luger et al. | 315/101 |
| 6,198,845 | B1 * | 3/2001 | Tse et al. | 382/169 |
| 6,366,031 | B2 * | 4/2002 | Klien | 315/291 |
| 6,972,531 | B2 * | 12/2005 | Krummel | 315/309 |
| 7,187,132 | B2 * | 3/2007 | Bakre | 315/94 |

* cited by examiner

*Primary Examiner*—Thuy Vinh Tran
(74) *Attorney, Agent, or Firm*—Carlo S. Bessone

(57) ABSTRACT

The present invention relates to a circuit arrangement for operating at least one lamp (LA), which has a first filament (W1) and a second filament (W2), it comprising an apparatus (10) for determining a variable which is correlated with the temperature of at least one of the two filaments (W1; W2). It also relates to a method for operating at least one lamp, which has a first and second filament, a variable correlated with the temperature of at least one of the two filaments being determined prior to restarting the lamp.

14 Claims, 1 Drawing Sheet

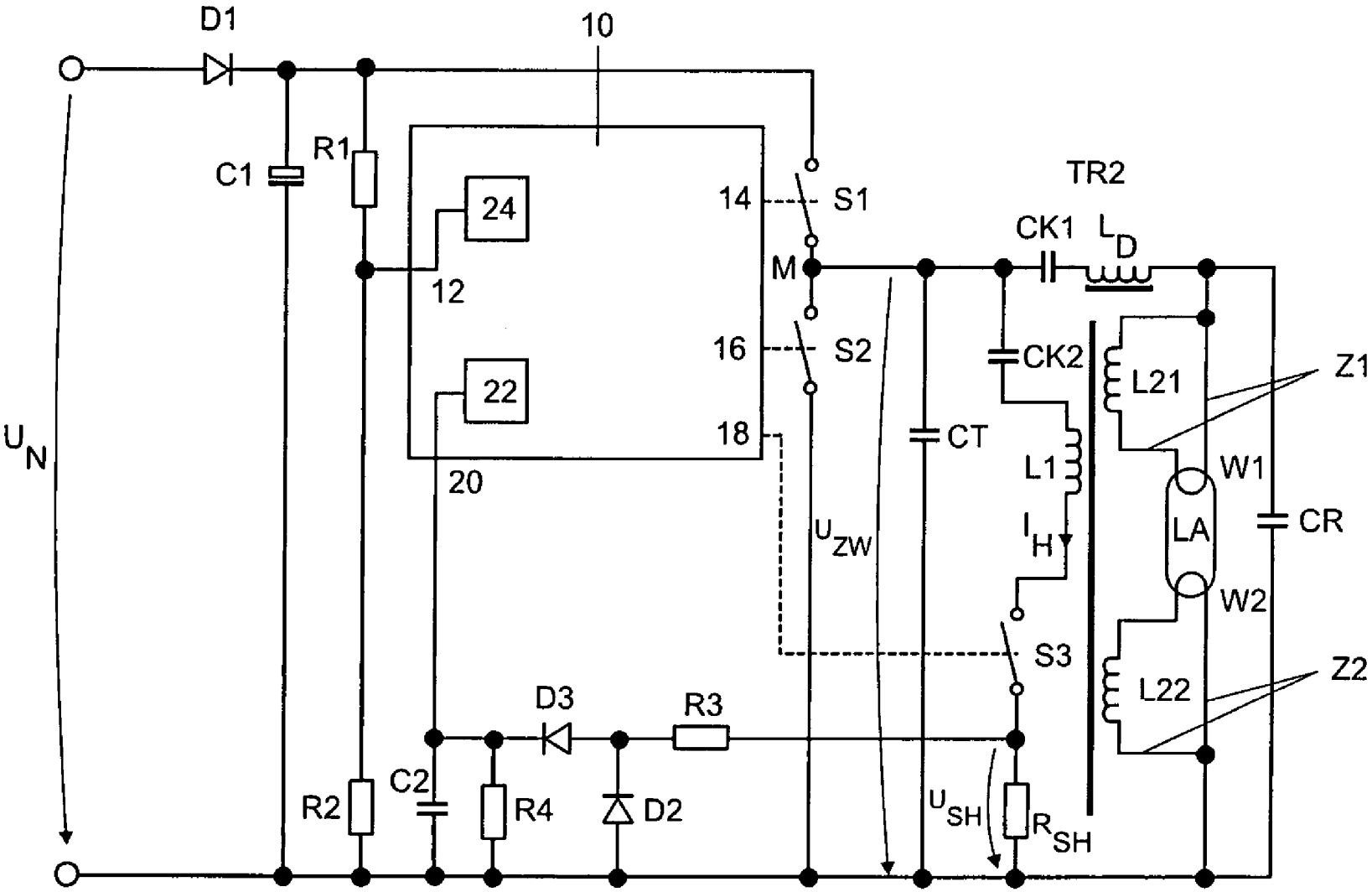
Z1
CR
Z2
W1
W2
LA
L21
L22
TR2
$L_D$
CK1
CK2
L1
$I_H$
S3
$R_{SH}$
CT
$U_{SH}$
S1
S2
$U_{ZW}$
M
14
16
18
10
R3
D2
D3
R4
24
22
12
20
C2
R1
R2
C1
D1
$U_N$

CIRCUIT ARRANGEMENT AND METHOD FOR OPERATING AT LEAST ONE LAMP

FIELD OF THE INVENTION

The present invention relates to a circuit arrangement and a method for operating at least one lamp, which has a first filament and a second filament. It relates in particular to the problem of restarting a lamp which has been extinguished as a result of an interruption to the voltage supply.

BACKGROUND OF THE INVENTION

In general, two variants are known in response to a lamp being extinguished as a result of an interruption to the voltage supply: in the first variant, the lamp is restarted without preheating, which could, however, result in a cold start. A cold start entails an increased work function of the electrons on the electrodes, which leads to premature wear of the filament electrodes. One advantage of this, however, is the fact that the lamp emits light again within a very short period of time. This procedure is therefore preferred, for example, when switching over to an emergency power supply. In the second variant, there is preheating again in any case, which leads to an additional dark phase of up to two seconds, depending on the lamp type, but 100% guarantees switching strength. A procedure known from the prior art which is improved compared to these two variants uses a timing element in order to establish the duration of the system interruption and to decide whether preheating is required again or not. This may lead to useful results in the case of circuit arrangements which have been constructed for a specific lamp type. Recently, however, so-called multilamp electronic ballasts (multilamp EBs) have been used more and more which can operate different types of lamp, i.e. in particular lamps with different types of filament. Owing to the different physical properties of the different types of filament, the procedure with determination of the time duration of the system interruption can therefore only be a compromise.

SUMMARY OF THE INVENTION

The object on which the invention is based therefore consists in developing the circuit arrangement mentioned initially or the method mentioned initially such that, as a result, it is possible for the lamp to be restarted with little wear and with as short a dark phase as possible, even in the case of multilamp EBs.

The present invention is based on the knowledge that multilamp EBs comprise filament recognition, i.e. are designed to measure specific filament parameters in order to determine from them the type of lamp and/or type of filament used in the circuit arrangement. A large number of these filament parameters are temperature-dependent, with the result that, if the type of lamp and/or type of filament is determined first, it is possible from this to infer the present temperature of the filament. Examples of filament parameters suitable for this purpose are the filament resistance, the current flowing through the filament during operation at a constant voltage and the voltage drop across a filament during operation from a current source. The lamp is only restarted, of course, when it has previously been established that the lamp has been extinguished as a result of the interruption to the supply voltage.

In the solution according to the invention, preheating is therefore started in order for it to be interrupted, with the corresponding filament parameter(s) being monitored permanently, at the time at which the filament is sufficiently warm for renewed starting. This may be the case even after a few ms.

The solution according to the invention is characterized by the fact that it provides optimum protection against coldstarting of a lamp whilst at the same time minimizing the necessary dark time for the case in which the filaments are still warm. As a result of the fact that a variable is determined which is correlated with the temperature of at least one of the two filaments, cases such as different cooling times owing to hot or cold lamps and tolerances of the filaments are also covered according to the invention.

One preferred development is characterized by the fact that it also has a preheating apparatus for the purpose of preheating the first filament and the second filament and a supply voltage connection, in which case it also has an apparatus for establishing a voltage dip at the supply voltage connection. If a time measurement apparatus is also provided in order to determine the duration of the voltage dip at the supply voltage connection, the activation of the apparatus for determining the variable correlated with the temperature and the subsequent preheating as a function of the variable correlated with the temperature can be made dependent on the specific time duration as long as the duration of the voltage dip determined by means of the time measurement apparatus exceeds a predeterminable limit value: for periods of time which are shorter than the limit value, the lamp is restarted immediately, whereas periods of time which are longer than the predeterminable limit value lead to activation of the preheating apparatus.

One preferred development is characterized by the fact that it also comprises a start-triggering apparatus, in which case it is also designed to actuate the start-triggering apparatus without the preheating apparatus being actuated in the meantime if the determined duration of the voltage dip at the supply voltage connection is below a predeterminable limit value, and to actuate the start-triggering apparatus if the determined duration of the voltage dip at the supply voltage connection is above a predeterminable limit value and the variable correlated with the temperature has reached a predeterminable value by means of the at least one filament being preheated.

The circuit arrangement is preferably designed for operating lamps having different types of filament and/or different types of lamp and comprises an apparatus for determining at least one filament parameter for the purpose of determining the type of filament and/or lamp and a memory device, to which the determined type of filament and/or lamp can be input. With this embodiment, the type of filament and/or lamp is accordingly determined using the filament parameter at the beginning of operation of a specific lamp, and this information is stored in a memory apparatus. If the values of at least one filament parameter of this type of filament and/or lamp at different temperatures are now stored in the memory apparatus, it is possible, in a simple manner, to infer the temperature of the filament from the value of the respective filament parameter. Instead of storing specific values for the at least one filament parameter at different temperatures, this correlation can, of course, also be expressed as a formula and stored, in which case the formula is evaluated for the purpose of determining the temperature or a variable correlated therewith. The variable correlated with the temperature, i.e. the filament parameter to be determined, is preferably the filament resistance. Alternatively, it is also possible for only one limit value of the temperature-dependent filament parameter to be input for the respective type of filament and/or lamp, in which case triggering of the starting is then dependent on whether the measured value for the temperature-dependent filament parameter is smaller or greater than this limit value.

The apparatus for determining the variable correlated with the temperature of at least one of the two filaments is preferably designed to apply a constant voltage to the first and/or second filament and to determine the current through the first and/or second filament in order to determine the filament resistance.

Particularly useful results can be achieved if the circuit arrangement is designed to take into account, when determining the filament resistance, the resistance of the supply line of the first and/or second filament.

Where applicable, the advantages mentioned in connection with the circuit arrangement according to the invention also apply to the method according to the invention.

Further advantageous embodiments are described in the dependent claims.

BRIEF DESCRIPTION OF THE DRAWINGS

An exemplary embodiment of a circuit arrangement according to the invention will now be described in more detail below with reference to the attached drawing, which shows a schematic illustration of an exemplary embodiment of a circuit arrangement according to the invention.

DETAILED DESCRIPTION OF THE INVENTION

The circuit arrangement according to the invention illustrated schematically in drawing 1 is operated on the input side with a system voltage $U_N$. A diode D1 and a capacitor C1 are used for rectifying the system voltage $U_N$. The input voltage at the input 12 of a control apparatus 10 is monitored via a voltage divider which comprises the resistors R1 and R2. An interruption to the power supply system can therefore be established at the input 12 of the control device 10.

The control apparatus 10 drives the two switches S1, S2 in the half-bridge arrangement with a radiofrequency signal in a known manner via its outputs 14 and 16. The so-called intermediate circuit voltage $U_{ZW}$ is provided at the center point M of the half-bridge arrangement. A trapezoidal capacitor CT is arranged between the center point M of the half-bridge arrangement and the reference potential. A lamp LA is connected on one side to a lamp inductor $L_D$ via its first filament W1, said lamp inductor $L_D$ being coupled to the center point M of the half-bridge arrangement via a coupling capacitor CK1. The second filament W2 of the lamp LA is coupled to the reference potential. A preheating apparatus can be activated via a switch S3, which is driven by an output 18 of the control apparatus 10. Said preheating apparatus comprises a coupling capacitor CK2 and a transformer Tr2, an inductance L1 being arranged on the primary side of said transformer Tr2, and firstly an inductance L21, which is coupled to the first filament W1 of the lamp LA, and, secondly, an inductance L22, which is coupled to the second filament W2 of the lamp LA, being arranged on the secondary side of said transformer Tr2. The supply line to the filament W1 is denoted by Z1, and the supply line to the filament W2 is denoted by Z2. A resonant capacitor CR, whose series resonance with the lamp inductor $L_D$ is used for starting the lamp LA, is arranged in parallel with the lamp. A shunt resistor $R_{SH}$ is used for determining the current during preheating in the branch CK2, L1, $R_{SH}$. The voltage drop $U_{SH}$ across the shunt resistor $R_{SH}$ is supplied to a rectifier, which comprises the diodes D2 and D3, the resistors R3 and R4 and the capacitor C2. The rectified voltage is supplied to the control apparatus 10 at its input 20. Moreover, a start-triggering apparatus (not illustrated) and a memory apparatus 22 are provided in the control apparatus 10, and these apparatuses will be described in more detail below. Moreover, a time measurement apparatus 24, which is coupled to the input 12 of the control apparatus 10 in order to determine the duration of a voltage dip in the system voltage $U_N$ is provided in the control apparatus 10.

Operation: the circuit arrangement illustrated represents a so-called multilamp EB, with which different types of lamp LA, in particular lamps having different types of filament, can be operated. When the circuit arrangement is first started once a lamp has been inserted, initially a filament parameter, for example the filament resistance, is determined in order to, as a result, determine the type of filament. For this purpose, the current $I_H$ through the shunt resistor $R_{SH}$ is measured, for example, the intermediate circuit voltage $U_{ZW}$ being known to the control apparatus 10 via the voltage divider R1, R2. A variable corresponding to the current $I_H$ is supplied to the control device 10 via the input 20. It is thus possible for the filament resistance to be determined in the control device 10 and for the type filament to be determined by consulting a table in the memory apparatus 22.

If a voltage dip in the system voltage $U_N$ is now detected at the input 12 of the control apparatus 10, its duration is determined by means of the time measurement apparatus 24. If the duration is below a specific limit value, the lamp LA is restarted immediately. If the determined duration is above a specific limit value, the present value for the filament resistance is determined by a voltage being applied to the filaments W1, W2 via the transformer Tr2. The current $I_H$ on the primary side is measured via the shunt resistor $R_{SH}$. From these two values, the transformation ratio ü of the transformer Tr2 and the intermediate circuit voltage $U_{ZW}$, the temperature-dependent filament resistance can be determined in the control apparatus 10. By means of a comparison with at least one value for the filament resistance stored in the memory apparatus for the respective type of filament, it is possible to establish whether preheating or further preheating is required prior to starting or whether the filaments W1, W2 already have a sufficiently high temperature in order to initiate starting of the lamp. In the case of a fixed intermediate circuit voltage $U_{ZW}$, the corresponding limit values for the current $I_H$ can also be stored according to the invention in the memory apparatus 22 in order for them to be used to ascertain the temperature of the filaments W1, W2.

The invention claimed is:

1. A circuit arrangement for operating at least one lamp, which has a first filament and a second filament, said circuit arrangement comprising:

an apparatus for determining a variable which is correlated with a temperature of at least one of the two filaments;

a preheating apparatus for preheating the first filament and the second filament;

a supply voltage connection;

an apparatus for detecting a voltage dip at the supply voltage connection;and a time measurement apparatus for determining the duration of the voltage dip at the supply voltage connection.

2. The circuit arrangement as claimed in claim 1, characterized in that it is designed to determine the variable correlated with the temperature of one of the two filaments by means of the apparatus for determining this variable, at least when the apparatus for detecting a voltage dip detects a voltage dip at the supply voltage connection and the duration of the voltage dip, determined by means of the time measurement apparatus, exceeds a predetermined limit value.

3. The circuit arrangement as claimed in claim 2, characterized in that it is designed to activate the preheating apparatus as a function at least of the variable correlated with the temperature, in particular until a predetermined value for the variable correlated with the temperature has been reached.

4. The circuit arrangement as claimed in claim 3, further comprising a staff-triggering apparatus, wherein said circuit arrangement is designed to actuate the start-triggering apparatus without the preheating apparatus being actuated in the meantime if the determined duration of the voltage dip at the supply voltage connection is below a predetermined limit value, and to actuate the start triggering apparatus if the determined duration of the voltage dip at the supply voltage connection is above a predetermined limit value and the variable correlated with the temperature has reached a predetermined value by means of the at least one filament being preheated.

5. The circuit arrangement as claimed in claim 3, characterized in that the circuit arrangement is designed for operating lamps having different types of filament and further comprises an apparatus for determining at least one filament parameter for the purpose of determining the type of filament and a memory device, to which the determined type of filament is stored.

6. The circuit arrangement as claimed in claim 2, further comprising a start-triggering apparatus, wherein said circuit arrangement is designed to actuate the start-triggering apparatus without the preheating apparatus being actuated in the meantime if the determined duration of the voltage dip at the supply voltage connection is below a predetermined limit value, and to actuate the start triggering apparatus if the determined duration of the voltage dip at the supply voltage connection is above a predetermined limit value and the variable correlated with the temperature has reached a predetermined value by means of the at least one filament being preheated.

7. The circuit arrangement as claimed in claim 2, characterized in that the circuit arrangement is designed for operating lamps having different types of filament and further comprises an apparatus for determining at least one filament parameter for the purpose of determining the type of filament and a memory device, to which the determined type of filament can is stored.

8. The circuit arrangement as claimed in claim 1, further composing a start-triggering apparatus, wherein said circuit arrangement is designed to actuate the start-triggering apparatus without the preheating apparatus being actuated in the meantime if the determined duration of the voltage dip at the supply voltage connection is below a predetermined limit value, and to actuate the start triggering apparatus if the determined duration of the voltage dip at the supply voltage connection is above a predetermined limit value and the variable correlated with the temperature has reached a predetermined value by means of the at least one filament being preheated.

9. The circuit arrangement as claimed in claim 1, characterized in that the variable correlated with the temperature is the filament resistance.

10. The circuit arrangement as claimed in claim 9, characterized in that it is designed to take into account, when determining the filament resistance, a resistance of a supply line of the first and/or second filament.

11. The circuit arrangement as claimed in claim 1, characterized in that the circuit arrangement is designed for operating lamps having different types of filament and further comprises an apparatus for determining at least one filament parameter for the purpose of determining the type of filament and a memory device, to which the determined type of filament is stored.

12. The circuit arrangement as claimed in claim 1, characterized in that the circuit arrangement is designed for operating lamps having different types of filament and further comprises an apparatus for determining at least one filament parameter for the purpose of determining the type of filament and a memory device, to which the determined type of filament is stored.

13. A circuit arrangement for operating at least one lamp, which has a first filament and a second filament, each of said two filaments being one of a plurality of filament types, said circuit arrangement comprising:

an apparatus for determining a filament parameter which is correlated with a temperature of at least one of the two filaments, said determined filament parameter identifying the filament type of the at least one filament; and a memory device having an input for receiving the identified filament type.

14. A circuit arrangement for operating at least one lamp, which has a first filament and a second filament, said circuit arrangement comprising:

an apparatus for determining a resistance of at least one of the two filaments that takes into account a resistance of a supply line of said at least one filament, wherein said determining includes applying a constant voltage to said at least one filament and measuring a current through said at least one filament, said filament resistance corresponding to a temperature of said at least one filament.

* * * * *